US009415598B2

(12) United States Patent
Matsumoto

(10) Patent No.: US 9,415,598 B2
(45) Date of Patent: Aug. 16, 2016

(54) IMAGE FORMING APPARATUS

(71) Applicant: Funai Electric Co., Ltd., Osaka (JP)

(72) Inventor: Akira Matsumoto, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 14/946,017

(22) Filed: Nov. 19, 2015

(65) Prior Publication Data

US 2016/0136960 A1 May 19, 2016

(30) Foreign Application Priority Data

Nov. 19, 2014 (JP) ..... 2014-234708

(51) Int. Cl.
*B41J 23/00* (2006.01)
*B41J 2/165* (2006.01)

(52) U.S. Cl.
CPC ..... *B41J 2/16547* (2013.01)

(58) Field of Classification Search
CPC .. B41J 2/16517; B41J 2/16505; B41J 2/1707; B41J 2/1414; B41J 2/16552; B41J 2/16538; B41J 2/16544; B41J 2/16547
See application file for complete search history.

(56) References Cited

U.S. PATENT DOCUMENTS 5,760,801 A * 6/1998 Jackson ..... B41J 2/16547 347/29
5,946,009 A * 8/1999 Youn ..... B41J 2/16547 347/22
5,984,450 A * 11/1999 Becker ..... B41J 2/16538 347/24
2007/0170279 A1* 7/2007 Yamamoto ..... B41J 2/16547 239/124

FOREIGN PATENT DOCUMENTS

JP 4508115 B2 7/2010

* cited by examiner

*Primary Examiner* — Julian Huffman
*Assistant Examiner* — Sharon A Polk
(74) *Attorney, Agent, or Firm* — Osha Liang LLP

(57) ABSTRACT

An image forming apparatus includes: a lead screw that includes a first region formed with a spiral groove and provided in a central portion of the lead screw, and two second regions formed without a groove, one provided on an end-portion side of the first region and the other provided on another end-portion side of the first region; a cap mechanism that includes a first threaded portion threaded to the groove and that lifts a cap member that covers an ejecting surface of ink, and a first linking portion; a wiper member that includes a second threaded portion threaded to the groove and that wipes ink adhered to the ejecting surface of the ink, and a second linking portion that links with the first linking portion.

15 Claims, 10 Drawing Sheets

First State (Standby State)

First State (Standby State)

IMAGE FORMING APPARATUS

TECHNICAL FIELD

This invention relates generally to an image forming apparatus and more particularly relates to an image forming apparatus comprising a printing head that ejects ink.

BACKGROUND ART

A conventional image forming apparatus comprising a printing head that ejects ink is known (for example, see Patent Literature 1).

Patent Literature 1 discloses an image forming apparatus comprising a printing head, a lead screw, and a wiper member and cap-lifting mechanism installed to the lead screw so as to move in an axial direction by a rotation of the lead screw. The wiper member and the cap-lifting mechanism are configured to be continuously threaded to the lead screw and to move on the same lead screw independently of each other.

The lead screw includes a first grooved portion formed with a spiral groove with a large pitch provided in a central portion and second grooved portions formed with a spiral groove with a small pitch provided on both end-portion sides of the first grooved portion. The wiper member is configured to wipe ink adhered to an ejecting surface of the printing head. The cap-lifting mechanism includes a cap member that covers the ejecting surface of the ink of the printing head. Moreover, the cap-lifting mechanism is configured to separate the cap member from the ejecting surface (lower the cap member) in conjunction with moving the first grooved portion with the large pitch. Therefore, the cap-lifting mechanism is configured to move the first grooved portion with the large pitch independently ahead of the wiper member for the wiper member to wipe the ink of the ejecting surface.

Specifically, in a standby state, the wiper member and the cap-lifting mechanism are disposed near each other and are both disposed in a state of being threaded to one of the second grooved portions with the small pitch. Moreover, the cap-lifting mechanism is disposed more on a first-grooved-portion-with-the-large-pitch side of the lead screw than the wiper member. Moreover, the cap-lifting mechanism separates from the wiper member that moves in the second grooved portion with the small pitch by independently moving in the first grooved portion by being threaded to the first grooved portion with the large pitch from the second grooved portion with the small pitch, and the cap member separates from the ejecting surface. While the cap-lifting mechanism is performing the separating operation from the ejecting surface, the wiper member moves in the second grooved portion with the small pitch; after the separating operation of the cap-lifting mechanism from the ejecting surface is ended, a wiping operation of the ink by the wiper member is performed by the wiper member moving by being threaded to the first grooved portion with the large pitch from the second grooved portion with the small pitch.

CITATION LIST

Patent Literature

[Patent Literature 1] Japanese Patent No. 4508115

SUMMARY OF THE INVENTION

However, in Patent Literature 1, the wiper member and the cap-lifting mechanism are continuously threaded to the same lead screw, even after the cap member is lowered (the cap member is separated from the ejecting surface) by the cap-lifting mechanism moving in the first grooved portion. Thus, the cap-lifting mechanism causes movement in the same direction (direction away from the first grooved portion) to continue in conjunction with the lead screw rotating to move the wiper member. Therefore, the size of the device tends to become large in order to ensure a movement amount of the cap-lifting mechanism. A similar tendency is indicated when the wiper member moves in the first grooved portion in advance (lifts the cap member to its original position).

According to one or more embodiments of the invention, an image forming apparatus can be reduced in size by suppressing movement amounts of a wiper member and a cap-lifting mechanism.

An image forming apparatus according to one aspect of this invention may comprise: a lead screw that includes a first region formed with a spiral groove provided in a central portion and second regions that are provided on both end-portion sides of the first region and not formed with the groove; a cap-lifting mechanism that is installed to the lead screw and includes a cap member covering an ejecting surface of ink of a printing head in conjunction with a movement in an axial direction by a rotation of the lead screw; and a wiper member that is installed to the lead screw and wipes ink adhered to the ejecting surface in conjunction with the movement in the axial direction by the rotation of the lead screw; wherein one of the cap-lifting mechanism and the wiper member is configured to independently start movement while being threaded to the groove of the first region, link with the other of the cap-lifting mechanism and the wiper member in a stationary state by moving a predetermined distance to thread the other to the groove of the first region, and move to the second region and stop.

In the image forming apparatus according to the one aspect of this invention, one of the cap-lifting mechanism and the wiper member is configured to independently start movement while being threaded to the groove of the first region, link with the other of the cap-lifting mechanism and the wiper member in the stationary state by moving the predetermined distance to thread the other to the groove of the first region, and move to the second region and stop. As a result, while the other of the cap-lifting mechanism and the wiper member moves in the first region, the one of the cap-lifting mechanism and the wiper member moved in advance to the second region can be stopped; therefore, movement amounts of the wiper member and the cap-lifting mechanism can be suppressed. As a result, the device can be suppressed from becoming large in size.

In the image forming apparatus according to the one aspect above, both the cap-lifting mechanism and the wiper member are configured to be disposed in a second region on the same end-portion side in a standby state that is maintained in a stationary state. As an example, when the cap-lifting mechanism and the wiper member move to one second-region side, a standby state is where the cap-lifting mechanism is disposed in the second region and the wiper member is threaded to the groove of the first region, and where the one of the cap-lifting mechanism and the wiper member is disposed in the second region, before the other reaches the second region, it becomes necessary to control a rotation count of the lead screw to stop the other at a predetermined position in the first region. By merely disposing both the cap-lifting mechanism and the wiper member in the second region of the lead screw, the cap-lifting mechanism and the wiper member can easily be put into the stationary state (standby state) without performing a control such as above.

Where both the cap-lifting mechanism and the wiper member are disposed in the second region, image forming apparatus further comprises a biasing member that imparts to the cap-lifting mechanism and the wiper member a biasing force toward the first region, and the biasing member is configured to not impart the biasing force to the other of the cap-lifting mechanism and the wiper member in a situation where, after the one of the cap-lifting mechanism and the wiper member is threaded to the first region by the biasing force, the other is disposed in the second region. As a result, where, in the standby state, both the cap-lifting mechanism and the wiper member are disposed in the second region on the same end-portion side, by the biasing member, only one of the cap-lifting mechanism and the wiper member can be easily threaded to the groove of the first region.

In the image forming apparatus according to the one aspect above, the cap-lifting mechanism and the wiper member respectively include a first linking portion and a second linking portion that link to each other; wherein at least one of the first linking portion and the second linking portion is formed so as to extend in the axial direction and is configured to link at a linking position separated a predetermined interval from an installation position on the lead screw. As a result, the first linking portion and the second linking portion can be linked at the linking position separated the predetermined interval from the installation position on the lead screw; this enables a simple configuration where the one of the cap-lifting mechanism and the wiper member links to the other after moving the predetermined distance.

In this situation, at least one of the first linking portion and the second linking portion includes an elastically-deforming portion that, when threading the one of the cap-lifting mechanism and the wiper member to the groove of the first region in a state where the first linking portion and the second linking portion are linked to each other, absorbs, by elastically deforming, movement of the other of the cap-lifting mechanism and the wiper member in the axial direction corresponding to at least one rotation of the spiral groove. As a result, even in a situation where the groove of the first region of the lead screw is in a rotation position where it cannot be immediately threaded to the one of the cap-lifting mechanism and the wiper member, by the elastically-deforming portion, the movement of the other of the cap-lifting mechanism and the wiper member in the axial direction corresponding to the at least one rotation of the spiral groove can be absorbed. As a result, the one of the cap-lifting mechanism and the wiper member can be reliably threaded to the groove of the first region of the lead screw while suppressing a large load from being applied to the first linking portion and the second linking portion.

In the configuration where the at least one of the first linking portion and the second linking portion includes the elastically-deforming portion, the elastically-deforming portion is made from a resin spring, a cushion member, or a compression spring. As a result, when the first linking portion and the second linking portion link, a large load being applied to the first linking portion and the second linking portion can be easily suppressed.

In the image forming apparatus according to the one aspect above, the wiper member includes a plurality of wiping units that wipes the ink by sliding over the ejecting surface, the cap member includes a plurality of sealing portions that covers the ejecting surface by abutting the ejecting surface, one lead screw is provided, and a configuration is such that an identical number of wiping units and sealing portions is disposed respectively on both sides of the lead screw in a horizontal direction orthogonal to the axial direction. As a result, an even load is applied on the lead screw, and the sealing portions and the wiping units can be suppressed from inclining in the horizontal direction; therefore, the ink of the ejecting surface can be wiped with an even pressure by the plurality of wiping units. Moreover, the ejecting surface can be sealed with an even pressure by the plurality of sealing portions.

An image-forming apparatus according to one or more embodiments of the invention comprises: a lead screw that comprises: a first region formed with a spiral groove and provided in a central portion of the lead screw, and two second regions formed without a groove, one provided on an end-portion side of the first region and the other provided on another end-portion side of the first region; a cap mechanism that comprises: a first threaded portion threaded to the groove and that lifts a cap member that covers an ejecting surface of ink, and a first linking portion; a wiper member that comprises: a second threaded portion threaded to the groove and that wipes ink adhered to the ejecting surface of the ink, and a second linking portion that links with the first linking portion, wherein the cap mechanism lifts or lowers the cap member and the wiper member wipes the ink when the lead screw is rotated; one of the cap mechanism and the wiper member starts moving from one of the second regions while the first threaded portion or the second threaded portion is threaded to the groove; upon moving a predetermined distance, the one of the cap mechanism and the wiper member links to the other that is in a stationary state via the first linking portion and the second linking portion; after the cap mechanism and the wiper member have linked, the first threaded portion or the second threaded portion is threaded to the groove of the first region, and upon reaching the other of the second regions, the one of the cap mechanism and the wiper member stops moving.

According to one or more embodiments of the invention, as above, the image forming apparatus is provided, that can be suppressed from becoming large in size by suppressing the movement amounts of the wiper member and the cap-lifting mechanism.

DETAILED DESCRIPTION OF THE INVENTION

Embodiments of the invention are described below based on the drawings.

First Example

A configuration of an image forming apparatus 100 according to one or more embodiments of the first example of the invention is described with reference to FIGS. 1 to 14.

Figure 1:
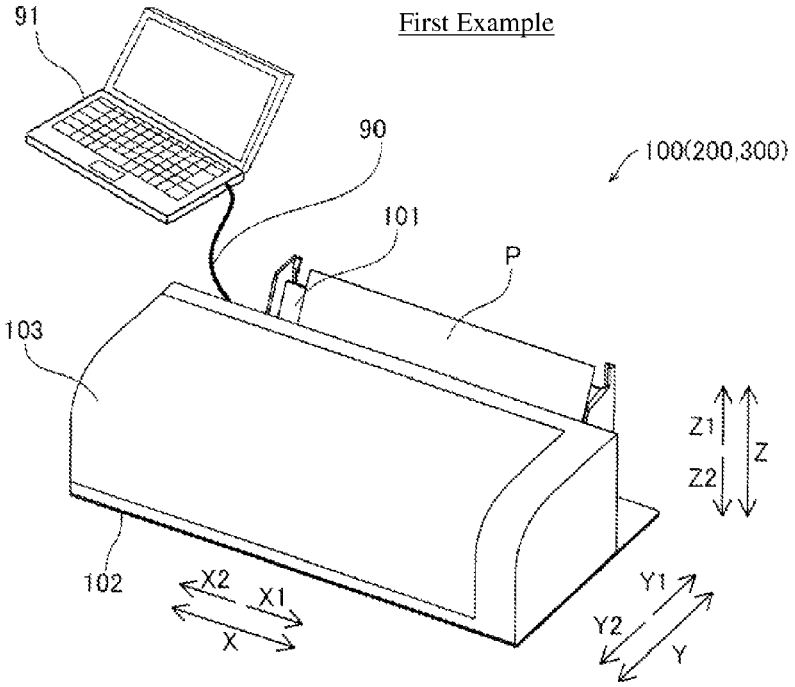
FIG. 1 is a perspective view illustrating a usage state of an image forming apparatus according to one or more embodiments of the invention.

As illustrated in FIG. 1, the image forming apparatus 100 is configured to be connectable to a personal computer 91 by a predetermined cable 90. The image forming apparatus 100 may comprise a paper-feed tray 101 on a rear side (Y1-direction side). Moreover, the image forming apparatus 100 is configured to be able to print an image based on image data acquired from the personal computer 91 on a sheet P fed from the paper-feed tray 101.

Below, an opposite side of the rear side on which the paper-feed tray 101 of the image forming apparatus 100 is disposed is defined as a front side (Y2-direction side) (side on which a motor 10 [see FIG. 2] of a maintenance unit 105 that is described below is disposed). Moreover, a direction orthogonal to an up-and-down direction (Z direction) and a front-and-rear direction (Y direction) is defined as a left-and-right direction (X direction). In the description below, the front-and-rear direction (Y direction) is a direction equivalent to an axial direction that is described below.

Figure 2:
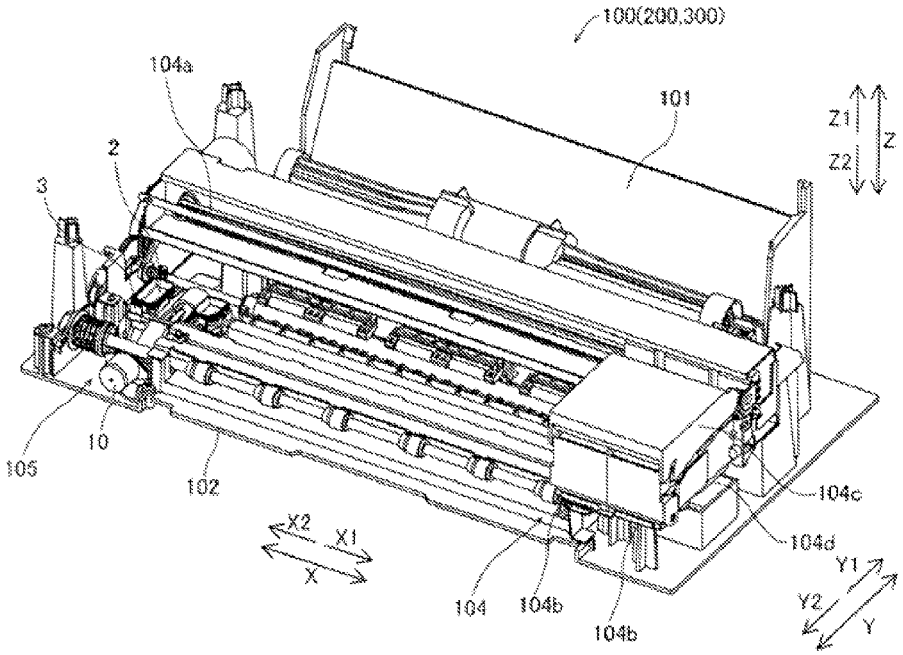
FIG. 2 is a perspective view illustrating an overall configuration of the image forming apparatus according to one or more embodiments of the invention.

As illustrated in FIG. 2, the image forming apparatus 100 may comprise a housing unit 102 disposed with various components, a cover portion 103 (see FIG. 1), a printing unit 104, and the maintenance unit 105. The cover portion 103 covers the housing unit 102 by being installed from above (Z1 direction) to the housing unit 102. The printing unit 104 is configured to perform printing on the sheet P by being moved by a belt 104*a* alternatingly in the left-and-right direction (X direction). The printing unit 104 is configured such that when printing, it moves in a region (printing region) above the sheet P. In FIG. 2, a configuration where the cover portion 103 is omitted is illustrated.

Figure 3:
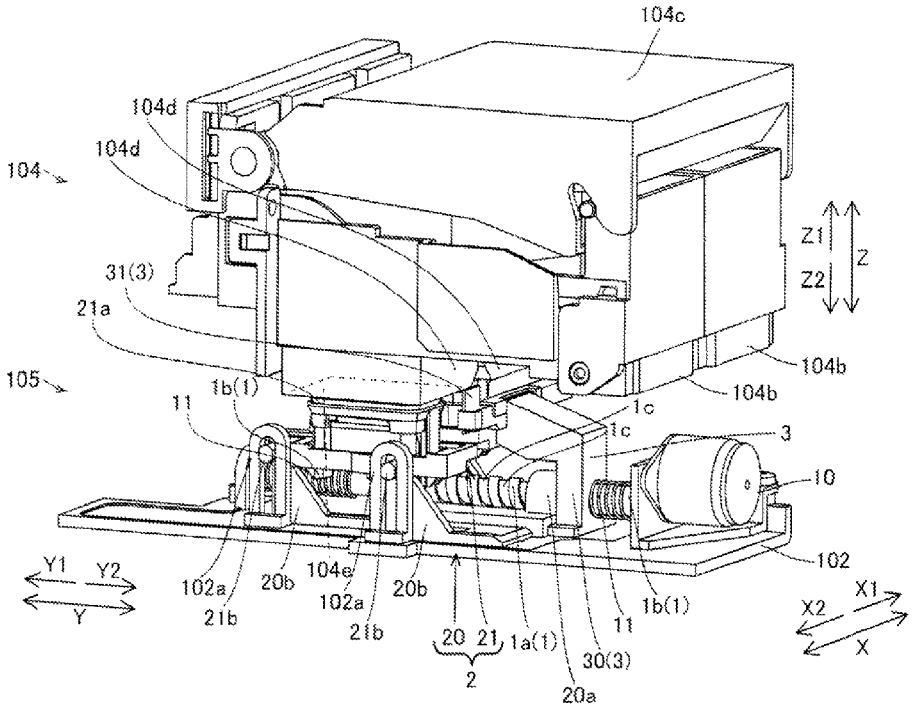
FIG. 3 is a perspective view illustrating a printing unit and a maintenance unit of the image forming apparatus according to one or more embodiments of the invention.

As illustrated in FIG. 3, the printing unit 104 includes ink cartridges 104*b*, a carriage 104*c* to which the ink cartridges 104*b* are mounted, and printing heads 104*d* provided so two line up in the left-and-right direction on a lower side (Z1-direction side) of the carriage 104*c*. Lower surfaces of the printing heads 104*d* are made to be ejecting surfaces 104*e* having nozzles (not illustrated) that eject ink.

The maintenance unit 105 is configured to perform a predetermined maintenance operation so the ink is favorably ejected from the printing heads 104*d* (ejecting surfaces 104*e*). Moreover, the maintenance unit 105 is disposed in a left-side end portion (X2-direction-side end portion) of the housing unit 102 to which the sheet P (see FIG. 1) is not conveyed. Moreover, the maintenance unit 105 is configured to perform the maintenance operation in a state where the printing unit 104 is disposed above the maintenance unit 105 (a non-printing region outside of the printing region). The maintenance operation is an operation that wipes the ejecting surfaces 104*e* of the ink of the printing heads 104*d* and an operation that seals the ejecting surfaces 104*e*. Moreover, the maintenance operation is performed before and after use of the image forming apparatus 100 (see FIG. 2) and the like.

Next, a detailed configuration of the maintenance unit 105 is described.

Figure 4:
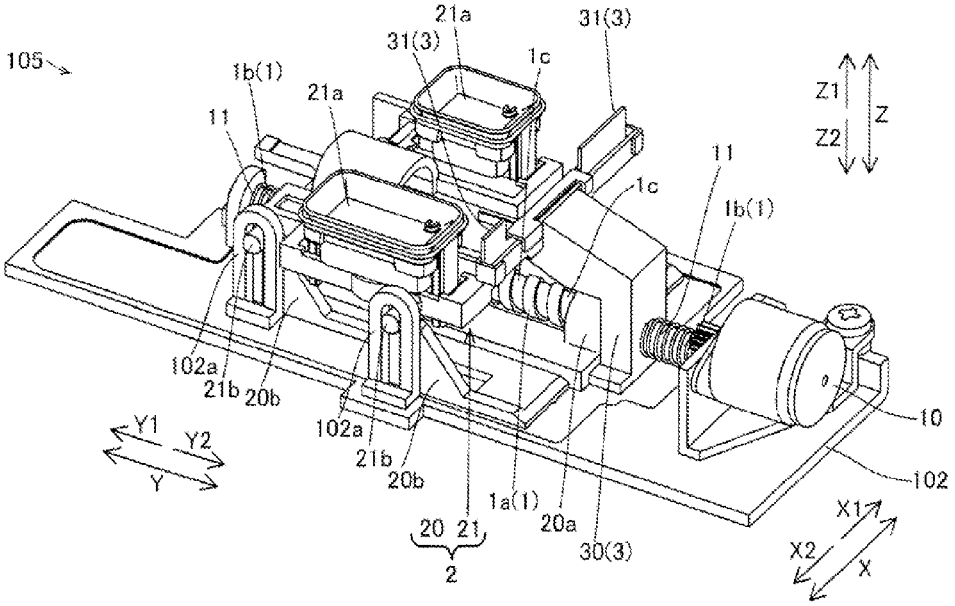
FIG. 4 is a perspective view illustrating the maintenance unit of the image forming apparatus according to one or more embodiments of the invention.

As illustrated in FIG. 4, the maintenance unit 105 (image forming apparatus 100 [see FIG. 2]) may comprise one lead screw 1 and a cap-lifting mechanism 2 (cap mechanism) and a wiper member 3 installed to the lead screw 1. The cap-lifting mechanism 2 and the wiper member 3 (moving objects) are configured to move in the axial direction (Y1 direction) in conjunction with a rotation of the lead screw 1. Moreover, the lead screw 1 includes a grooved portion 1*a* formed with a spiral groove 1*c* provided in a central portion and non-grooved portions 1*b* of a round-shaft shape that are provided on both end-portion sides of the grooved portion 1*a* and are not formed with the groove 1*c*. The grooved portion 1*a* is an example of the "first region" of the invention. Moreover, the non-grooved portion 1*b* is an example of the "second region" of the invention.

Here, in the first example, the maintenance unit 105 (image forming apparatus 100) is configured to independently move the cap-lifting mechanism 2 (or wiper member 3) while threading the cap-lifting mechanism 2 (or wiper member 3) to the groove 1*c* of the grooved portion 1*a*. Moreover, the maintenance unit 105 (image forming apparatus 100) is configured to link the cap-lifting mechanism 2 (wiper member 3) and the wiper member 3 (cap-lifting mechanism 2) in a stationary state and thread the wiper member 3 (cap-lifting mechanism 2) to the groove 1*c* of the grooved portion 1*a* by moving the cap-lifting mechanism 2 (wiper member 3) a predetermined distance. Moreover, the maintenance unit 105 (image forming apparatus 100) is configured to move the cap-lifting mechanism 2 (wiper member 3) to the non-grooved portion 1*b* and stop the cap-lifting mechanism 2 (wiper member 3). Details are described below.

The lead screw 1 is disposed on the housing unit 102 so an axial direction thereof ("axial direction" is hereinbelow defined as the axial direction of the lead screw 1) extends in the front-and-rear direction (Y direction). Moreover, the motor 10 is disposed on a front (Y2 direction) end portion of the lead screw 1. The lead screw 1 is configured to be able to rotate (normally and in reverse) by this motor 10.

Furthermore, a compression spring 11 is provided in each of the two non-grooved portions 1*b* of the lead screw 1. These compression springs 11 are disposed so end portions on opposite sides of the grooved portion 1*a* abut the housing unit 102. Therefore, movement of the compression springs 11 in the axial direction is regulated by the end portions on the opposite sides of the grooved portion 1*a*. The compression springs 11 are an example of the "biasing member" of the invention.

Figure 12:
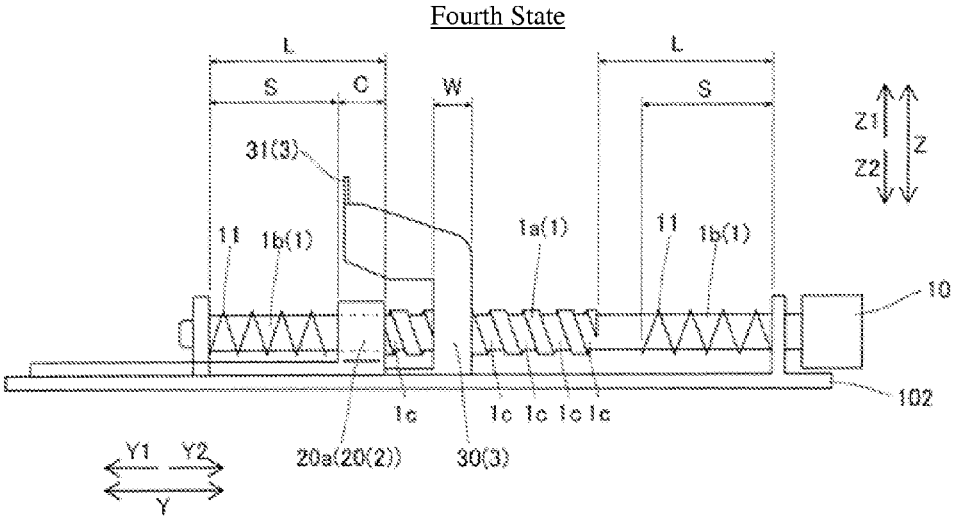
FIG. 12 is a schematic side view of a fourth state of the image forming apparatus according to one or more embodiments of the invention.

Furthermore, as illustrated in FIG. 12, a sum of a size C of a cap thread portion 20*a* (portion where the cap-lifting mechanism 2 is threaded to the groove 1*c* of the grooved portion 1*a*) that is described below in the axial direction and a size S (natural length) of the compression springs 11 in the axial direction is set to be less than or equal to a size L of the non-grooved portion 1*b* in the axial direction.

Furthermore, a sum of a size W of a wiper thread portion 30 (portion where the wiper member 3 is threaded to the groove 1*c* of the grooved portion 1*a*) that is described below in the axial direction and the size S (natural length) of the compression springs 11 in the axial direction is set to be less than or equal to the size L of the non-grooved portion 1*b* in the axial direction.

Furthermore, a sum of the size C of the cap thread portion 20*a* in the axial direction, the size W of the wiper thread portion 30 in the axial direction, and the size S (natural length) of the compression springs 11 in the axial direction is set to be greater than the size L of the non-grooved portion 1*b* in the axial direction. Sizes of the two non-grooved portions 1*b* in the axial direction may be different from each other but are made to be the same size in the description.

Furthermore, the lead screw 1 is configured to dispose the cap-lifting mechanism 2 and the wiper member 3 in a non-grooved portion 1*b* on the same end-portion side when both the cap-lifting mechanism 2 and the wiper member 3 are in a standby state. "Standby state" signifies a state at a point of starting (or ending) the maintenance operation. Moreover, in the standby state, both the cap-lifting mechanism 2 and the wiper member 3 are maintained in a stationary state. Therefore, because a compression spring 11 enters a state of being compressed from its natural length when both the cap-lifting mechanism 2 and the wiper member 3 are disposed in the non-grooved portion 1*b*, the compression spring 11 is configured to impart a biasing force toward the grooved portion 1*a* to the cap-lifting mechanism 2 and the wiper member 3.

Furthermore, after the cap-lifting mechanism 2 (wiper member 3) is threaded to the groove 1*c* of the grooved portion 1*a* by the above biasing force, when the wiper member 3 (cap-lifting mechanism 2) is disposed in the non-grooved portion 1*b*, the compression spring 11 is configured to not impart a biasing force to the wiper member 3 (cap-lifting mechanism 2).

Furthermore, the lead screw 1 is configured such that the same number (one each) of wiping units 31 described below and sealing portions 21*a* described below included in the cap-lifting mechanism 2 is disposed on both sides in a horizontal direction (left-and-right direction [X direction]) orthogonal to the axial direction.

The cap-lifting mechanism 2 is configured to be able to cover the ejecting surfaces 104*e* (see FIG. 3) of the ink of the printing heads in conjunction with movement in the axial direction. Moreover, the cap-lifting mechanism 2 includes a lifting member 20 disposed on the lead screw 1 and a cap member 21 that is disposed above (Z1 direction) the lifting member 20, separate from the lifting member 20, and disposed on the housing unit 102.

The lifting member 20 is disposed on the lead screw 1 and is configured to be able to move in the axial direction in conjunction with the rotation of the lead screw 1. Moreover, the lifting member 20 is installed more to a rear side (Y1-direction side) than the wiper member 3 on the lead screw 1. Moreover, the lifting member 20 has the cap thread portion 20*a* that is threaded to the lead screw 1 and an inclined portion 20*b*.

When the cap thread portion 20*a* of the lifting member 20 is disposed on the non-grooved portion 1*b* on the rear side (Y1-direction side), the cap thread portion 20*a* is configured to be able to abut the compression spring 11 on the rear side. Moreover, when the cap thread portion 20*a* is disposed on the non-grooved portion 1*b* on the front side (Y2-direction side) (in this situation, the wiper thread portion 30 is also disposed on the non-grooved portion 1*b* on the front side), the cap thread portion 20*a* is configured to abut the grooved portion 1*a* on the rear side (Y1-direction side) and the wiper thread portion 30 on the front side (Y2-direction side). At this time, the cap thread portion 20*a* is configured to receive a biasing force toward the rear side (grooved-portion 1*a* side) via the wiper thread portion 30 by the compression spring 11 on the front side (Y2-direction side).

Figure 5:
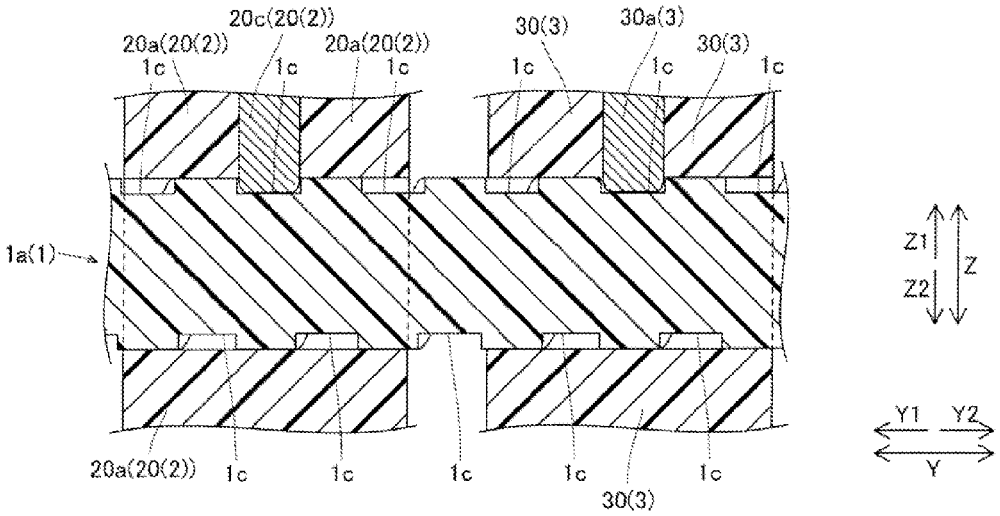
FIG. 5 is a schematic cross-sectional view illustrating a lead screw, a cap thread portion, and a wiper thread portion of the image forming apparatus according to one or more embodiments of the invention.

Furthermore, as illustrated in FIG. 5, a thread pin 20*c* that is threaded to the groove 1*c* of the grooved portion 1*a* of the lead screw 1 is provided on an inner side of the cap thread portion 20*a* of the lifting member 20. The thread pin 20*c* extends in a radial direction of the lead screw 1. The lifting member 20 is configured to be able to move in the axial direction by this thread pin 20*c* moving along a groove portion of the grooved portion 1*a*.

As illustrated in FIG. 4, the inclined portion 20*b* of the lifting member 20 is formed in a triangular shape having an inclined surface that increases in height heading from the front (Y2 direction) to the rear (Y1 direction). Moreover, one inclined portion 20*b* (not illustrated) is provided on a right-direction side (X1-direction side) of the lead screw 1, and two inclined portions 20*b* are provided on a left-direction side.

The cap member 21 is configured to be held in a state of covering the ejecting surfaces 104*e* (see FIG. 3) when the image forming apparatus 100 (see FIG. 2) is turned off. Moreover, the cap member 21 is installed to the housing unit 102 so as to be able to move in the up-and-down direction (Z direction) in conjunction with the movement of the lifting member 20 in the axial direction. The cap member 21 is configured to move downward (Z2 direction) (descend) in conjunction with movement of the lifting member 20 to the rear (Y1 direction) and move upward (Z1 direction) (rise) in conjunction with movement of the lifting member 20 to the front (Y2 direction). Moreover, the cap member 21 has the sealing portions 21*a* and lifting pins 21*b*.

The sealing portions 21*a* of the cap member 21 are configured so as to cover the ejecting surfaces 104*e* (see FIG. 3) of the printing heads 104*d* by abutting the ejecting surfaces 104*e*. Moreover, as above, one sealing portion 21*a* is disposed respectively on both sides, left and right, of the lead screw 1. Moreover, the sealing portions 21*a* are disposed on an upper side (Z1-direction side) of the cap member 21 and configured to cover the ejecting surfaces 104*e* in a state where the cap member 21 is lifted and to be separated from the ejecting surfaces 104*e* of the printing unit 104 in a state where the cap member 21 is lowered. Moreover, the sealing portions 21*a* are formed in a dish shape whose center is recessed downward (Z2 direction).

The lifting pins 21*b* of the cap member 21 are provided respectively in positions corresponding to the three inclined portions 20*b* of the lifting member 20. Provided in the housing unit 102 are guide groove portions 102*a* extending in the up-and-down direction (Z direction) in which the lifting pins 21*b* are engaged. The cap member 21 is configured to be lifted by the lifting pins 21*b* moving in the up-and-down direction (Z direction) along these guide groove portions 102*a*. A configuration of linking the above cap-lifting mechanism 2 (lifting member 20) and wiper member 3 is given in combination with a description of the wiper member 3.

The wiper member 3 is configured to wipe the ink adhered to the ejecting surfaces 104*e* (see FIG. 3). The wiper member 3 is disposed on the lead screw 1 and is configured to be able to move in the axial direction in conjunction with the rotation of the lead screw 1. Moreover, the wiper member 3 has the wiper thread portion 30 threaded to the lead screw 1 and the wiping units 31.

When the wiper thread portion 30 of the wiper member 3 is disposed on the non-grooved portion 1*b* on the front side (Y2-direction side), the wiper thread portion 30 is configured to be able to abut the compression spring 11 on the front side. Moreover, when the wiper thread portion 30 is disposed on the non-grooved portion 1*b* on the rear side (Y1-direction side) (in this situation, the cap thread portion 20*a* is also disposed on the non-grooved portion 1*b* on the rear side), the wiper thread portion 30 is configured to abut the grooved portion 1*a* on the front side (Y2-direction side) and the cap thread portion 20*a* on the rear side (Y1-direction side). At this time, the wiper thread portion 30 is configured to receive a biasing force toward the front side (grooved-portion 1*a* side) via the cap thread portion 20*a* by the compression spring 11 on the rear side (Y1-direction side).

Furthermore, as illustrated in FIG. 5, a thread pin 30*a* that is threaded to the groove 1*c* of the grooved portion 1*a* of the lead screw 1 is provided to the wiper thread portion 30.

As illustrated in FIG. 4, the wiping units 31 of the wiper member 30 are configured to wipe the ink by sliding over the ejecting surfaces 104*e* (see FIG. 3). Moreover, as above, one wiping unit 31 is disposed respectively on both sides, left and right, of the lead screw 1. Moreover, the sealing portions 21*a* are disposed on an upper side (Z1-direction side) of the wiper member 3 and is configured to slide over the ejecting surfaces 104*e* by moving in the front-and-rear direction (Y direction) in a state where the printing unit 104 is disposed above (Z1 direction) the maintenance unit 105 (in the non-printing region).

Next, the configuration of linking the cap-lifting mechanism 2 (lifting member 20) and the wiper member 3 is described.

Figure 6:
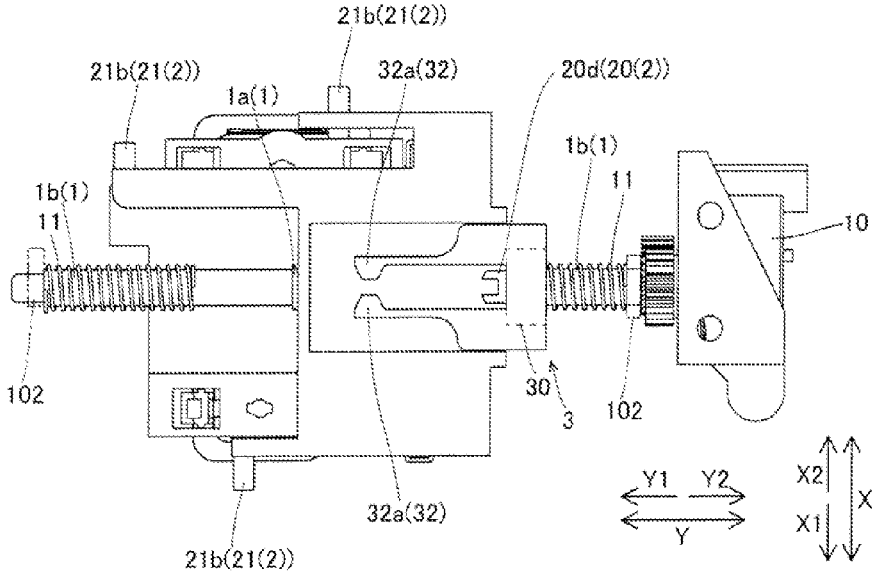
FIG. 6 is a bottom view illustrating the lead screw, a cap-lifting mechanism, and a wiper member of the image forming apparatus according to one or more embodiments of the invention.

As illustrated in FIG. 6, the cap-lifting mechanism 2 (lifting member 20) and the wiper member 3 respectively include a first linking portion 20*d* and a second linking portion 32 that link to each other. The first linking portion 20*d* and the second linking portion 32 are each disposed on a lower side (Z2-direction side) of the cap-lifting mechanism 2 and the wiper member 3. Moreover, the second linking portion 32 is configured to extend in the axial direction. As a result, the second linking portion 32 is configured to link at a linking position separated by a predetermined distance from its installation position to the lead screw 1 (wiper thread portion 30).

Furthermore, the second linking portion 32 is configured to be able to absorb movement of the cap-lifting mechanism 2 in the axial direction corresponding to one rotation of the spiral groove 1*c* by elastically deforming when threading the wiper member 3 to the groove 1*c* of the grooved portion 1*a* in a state where the first linking portion 20*d* and the second linking portion 32 are linked to each other.

The second linking portion 32 has a forked resin spring 32*a* formed in a forked shape extending rearward (Y2 direction) divided into two. Moreover, the forked resin spring 32*a* is formed in a hook shape where tips (rear ends) protrude to an inner side. The first linking portion 20*d* is formed in a block shape disposed in a position interposed between the tines of the forked resin spring 32*a* of the second linking portion 32. Moreover, the first linking portion 20*d* is configured to be able to relatively move relative to the second linking portion 32 a predetermined range between the tines of the forked resin spring 32*a* from a position abutting the hook-shaped tips (rear ends) of the forked resin spring 32*a* to a position abutting the wiper thread portion 30.

Furthermore, the second linking portion 32 is configured to be able to absorb the movement of the cap-lifting mechanism 2 in the axial direction corresponding to one rotation of the spiral groove 1*c* by elastically deforming (see FIG. 11) by the first linking portion 20*d* abutting the hook-shaped tips (rear ends) of the forked resin spring 32*a* and elastically deforming the forked resin spring 32*a* to spread outward. In short, the second linking portion 32 is configured so that in a state where the wiper member 3 is abutting the grooved portion 1*a* and when the thread pin 30*a* of the wiper thread portion 30 is not in a position corresponding to the groove 1*c* of the grooved portion 1*a*, even if the first linking portion 20*d* (cap-lifting mechanism 2) moves relative to the second linking portion 32 (wiper member 3), the linkage is maintained by the thread pin 30*a* elastically deforming until becoming threaded to the groove 1*c* of the grooved portion 1*a*.

Next, movement of the cap-lifting mechanism 2 (lifting member 20) and the wiper member 3 from the front side to the rear side (maintenance operation) is described.

Figure 7:
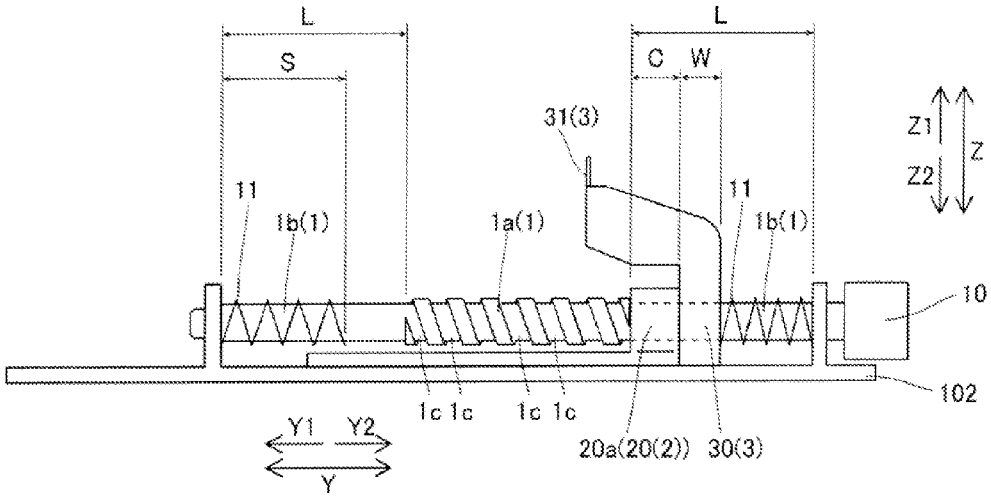
FIG. 7 is a schematic side view of a first state of the image forming apparatus according to one or more embodiments of the invention.
Figure 9:
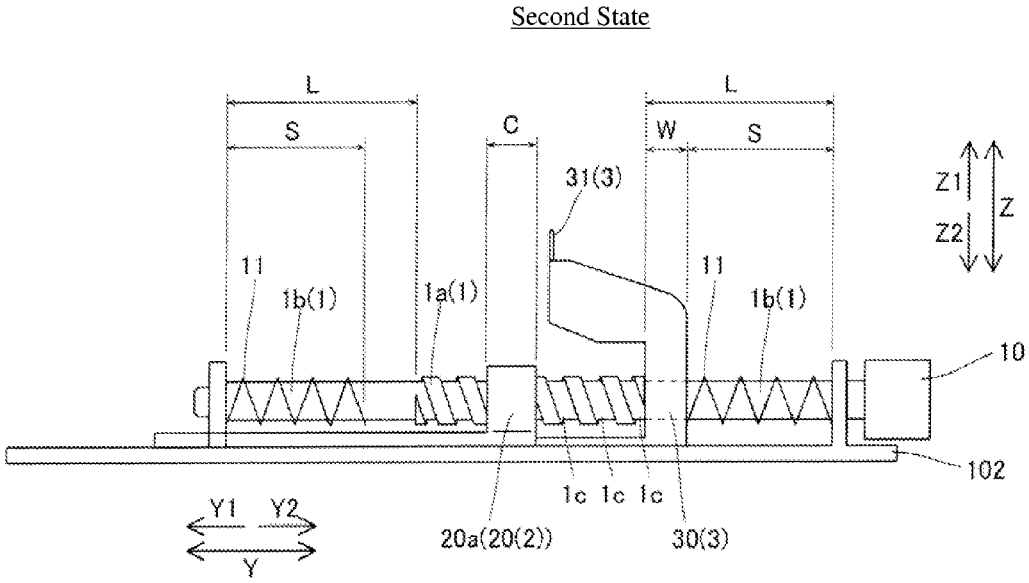
FIG. 9 is a schematic side view of a second state of the image forming apparatus according to one or more embodiments of the invention.

A premise of the following description is that the two compression springs 11 are identical. Moreover, as illustrated in FIGS. 7, 9, and 12, the natural lengths of the two compression springs 11 are both made to be S, as above. Moreover, the sizes of the two non-grooved portions 1*b* in the axial direction are both made to be L. Moreover, the size of the wiper thread portion 30 in the axial direction is made to be W. Moreover, the size of the cap thread portion 20*a* in the axial direction is made to be C.

As described above, a relationship of $W+C+S>L$, a relationship of $W+S\leq L$, and a relationship of $C+S\leq L$ are established between these lengths. In short, when the cap-lifting mechanism 2 and the wiper member 3 are disposed on the non-grooved portion 1*b* on the same side, by the compression spring 11, in conjunction with a rotation of the lead screw 1 in a predetermined direction, of the cap-lifting mechanism 2 and the wiper member 3 on the grooved-portion 1*a* side, only the one on the grooved-portion 1*a* side becomes threaded to the groove 1*c* of the grooved portion 1*a*. In the following description, description is given as $W+S=L$, $C+S=L$, and $C=W$.

Figure 8:
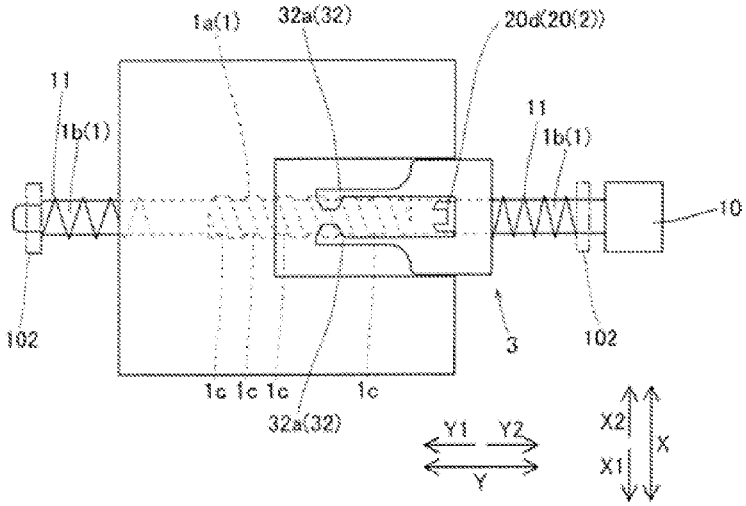
FIG. 8 is a schematic bottom view of the first state of the image forming apparatus according to one or more embodiments of the invention.

First, as illustrated in FIGS. 7 and 8, the cap-lifting mechanism 2 and the wiper member 3 are both disposed on the non-grooved portion 1*b* on the front side (Y2-direction side). That is, they are in the standby state (described hereinbelow as a first state). In this first state, the cap member 21 (see FIG. 4) covers the ejecting surfaces 104*e* (see FIG. 3). Moreover, in the first state, the compression spring 11 on the front side is in a compressed state. Therefore, by the lead screw 1 rotating in the predetermined direction (rotating normally), the cap-lifting mechanism 2 is threaded to the groove 1*c* of the grooved portion 1*a*.

Furthermore, by the cap-lifting mechanism 2 being threaded to the groove 1*c* of the grooved portion 1*a*, rearward (Y1 direction) movement starts independently. As the cap-lifting mechanism 2 (lifting member 20) moves rearward, the cap member 21 gradually descends (separates from the ejecting surfaces 104*e*). The wiper member 3 moves for a short time immediately after the cap-lifting mechanism 2 is threaded to the groove 1*c* of the grooved portion 1*a* until the compression spring 11 on the front side reaches its natural length. Then, by the cap member 21 completing its descent, the operation transitions from the first state to a second state.

Figure 10:
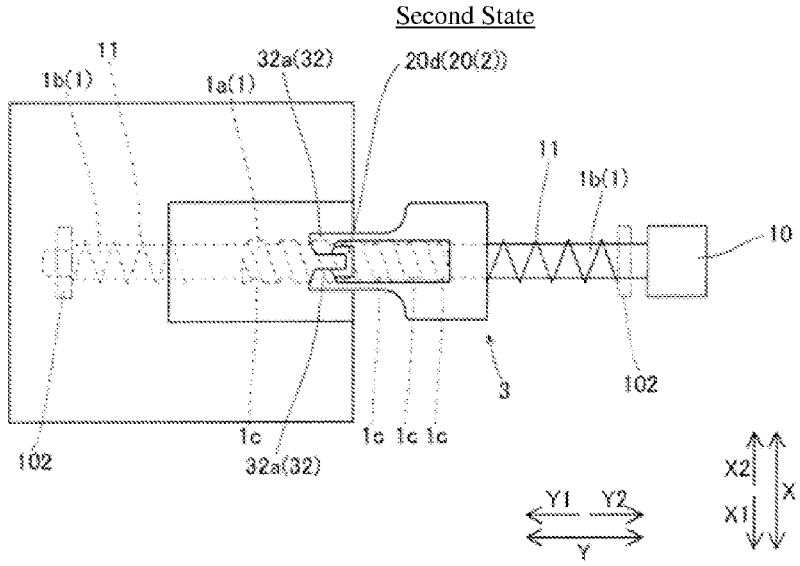
FIG. 10 is a schematic bottom view of the second state of the image forming apparatus according to one or more embodiments of the invention.

As illustrated in FIGS. 9 and 10, the second state is a state at the instant the first linking portion 20*d* of the cap-lifting mechanism 2 and the second linking portion 32 of the wiper member 3 abut. Moreover, it is a state where the compression spring 11 on the front side (Y2-direction side) is at the natural length S and where the wiper member 3 and the grooved portion 1*a* abut. The second state is defined such that in a circumferential direction of the lead screw 1, the groove 1*c* of the grooved portion 1*a* of the lead screw 1 is not in a position corresponding to the thread pin 30*a* of the wiper member 3.

Then, the lead screw 1 is rotated normally in a range of one revolution or less. In other words, the lifting member 20 is independently moved further slightly rearward (Y1 direction). The wiper member 3 does not move from the non-grooved portion 1*b* while abutting an end portion of the grooved portion 1*a*. As a result, the operation transitions from the second state to a third state.

Figure 11:
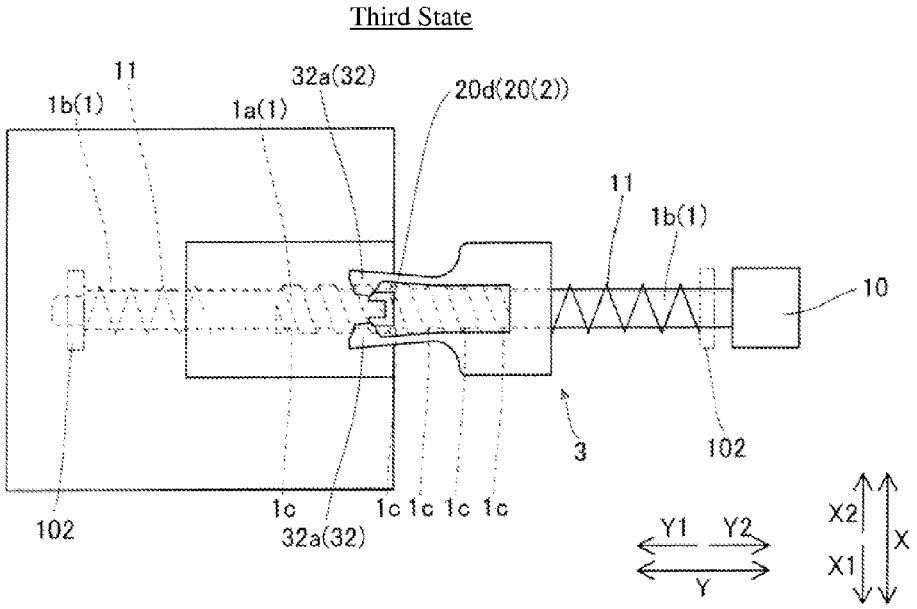
FIG. 11 is a schematic bottom view of a third state of the image forming apparatus according to one or more embodiments of the invention.

As illustrated in FIG. 11, the third state is a state where in the circumferential direction of the lead screw 1, the groove 1*c* of the grooved portion 1*a* of the lead screw 1 is disposed in a position corresponding to the thread pin 30*a* of the wiper member 3. In this third state, the second linking portion 32 (forked resin spring 32*a*) is in a state of being elastically deformed.

Then, at the instant the third state is entered into, the wiper member 3 becomes threaded to the groove 1*c* of the grooved portion 1*a*. Then, when the cap-lifting mechanism 2 and the wiper member 3 both move rearward (Y1 direction) in the grooved portion 1*a*, the cap-lifting mechanism 2 arrives at the non-grooved portion 1*b* on the rear side (Y1-direction side) so the operation transitions to a fourth state.

Figure 13:
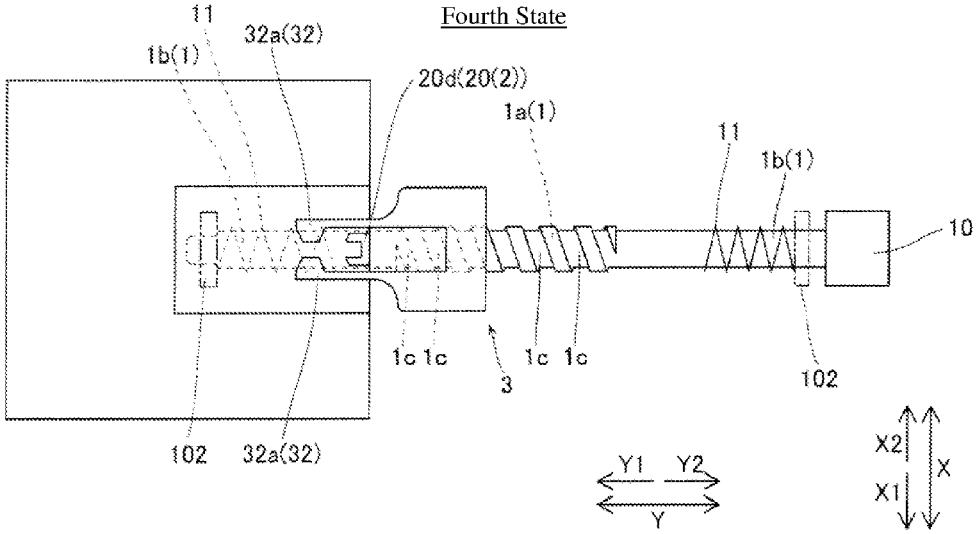
FIG. 13 is a schematic bottom view of the fourth state of the image forming apparatus according to one or more embodiments of the invention.

As illustrated in FIGS. 12 and 13, the fourth state is a state where the cap-lifting mechanism 2 arrives at the non-grooved portion 1*b* and enters a stationary state and where the wiper member 3 independently moves rearward (Y1 direction). In this fourth state, the cap-lifting mechanism 2 is stopped, and the wiper member 3 is moving so as to approach the cap-lifting mechanism 2; therefore, the linkage between the first linking portion 20*d* and the second linking portion 32 (see FIG. 13) is released.

Then, by the wiper member 3 arriving at the non-grooved portion 1*b* in the rear (Y1 direction), the cap-lifting mechanism 2 and the wiper member 3 both enter the standby state of being disposed on the non-grooved portion 1*b* on the rear side. Moreover, in the standby state, the cap member 21 is separated from the ejecting surfaces 104*e* (see FIG. 3). The maintenance operation that moves the cap-lifting mechanism 2 (lifting member 20) and the wiper member 3 from the front side to the rear side is mainly performed when the image forming apparatus 100 (see FIG. 2) is turned on.

Next, movement of the cap-lifting mechanism 2 (lifting member 20) and the wiper member 3 from the rear side to the front side (maintenance operation) is described. The movement from the rear side to the front side is similar to the movement from the front side to the rear side described above and is therefore described simply.

Figure 14:
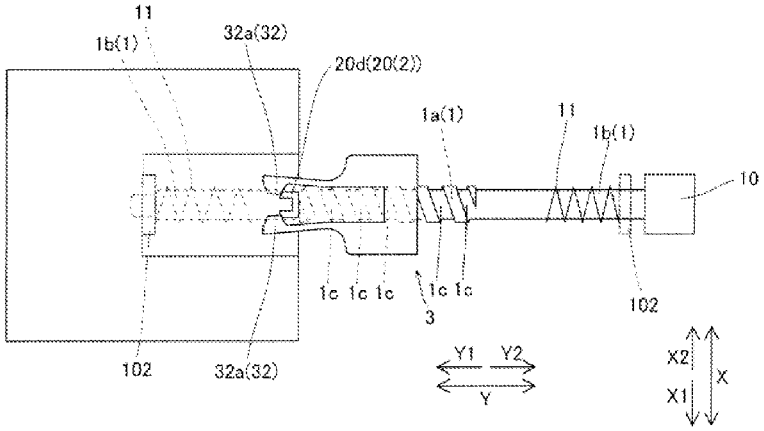
FIG. 14 is a view illustrating a state where the cap-lifting mechanism and the wiper member of the image forming apparatus according to one or more embodiments of the invention are moving from a rear side to a front side.

First, the cap-lifting mechanism 2 and the wiper member 3 are both disposed on the non-grooved portion 1*b* on the rear side (Y1-direction side). That is, they are in the standby state. In this state, the cap member 21 (see FIG. 3) is separated from the ejecting surfaces 104*e* (see FIG. 3). Then, by the lead screw 1 rotating in reverse, the wiper member 3 independently moves forward (Y2 direction). Then, by the first linking portion 20*d* and the second linking portion 32 being linked and, as illustrated in FIG. 14, the forked resin spring 32*a* elastically deforming, the cap-lifting mechanism 2 is threaded to the groove 1*c* of the grooved portion 1*a*. Moreover, as illustrated in FIGS. 9 and 10, the wiper member 3 arrives at the non-grooved portion 1*b* and enters the stationary state, and the cap-lifting mechanism 2 independently starts forward (Y2 direction) movement.

Then, by the cap-lifting mechanism 2 arriving at the non-grooved portion 1*b* in the front (Y2 direction), as illustrated in FIGS. 7 and 8, the cap-lifting mechanism 2 and the wiper member 3 both enter the standby state of being disposed on the non-grooved portion 1*b* on the front side. Moreover, in the standby state, the cap member 21 covers the ejecting surfaces 104*e* (see FIG. 3). The maintenance operation that moves the cap-lifting mechanism 2 (lifting member 20) and the wiper member 3 from the rear side to the front side is mainly performed when the image forming apparatus 100 (see FIG. 2) is turned off.

According to one or more embodiments of the first example, effects such as below can be obtained.

In the first example, as above, one of the cap-lifting mechanism 2 and the wiper member 3 is configured to independently start movement while being threaded to the groove 1*c* of the grooved portion 1*a*, link with the other of the cap-lifting mechanism 2 and the wiper member 3 in the stationary state by moving the predetermined distance to thread the other to the groove 1*c* of the grooved portion 1*a*, and move to the non-grooved portion 1*b* and stop. As a result, while the other of the cap-lifting mechanism 2 and the wiper member 3 moves in the grooved portion 1*a*, the one of the cap-lifting mechanism 2 and the wiper member 3 moved in advance to the non-grooved portion 1*b* can be stopped; therefore, movement amounts of the wiper member 3 and the cap-lifting mechanism 2 can be suppressed. As a result, the device can be suppressed from becoming large in size.

Furthermore, in the first example, as above, both the cap-lifting mechanism 2 and the wiper member 3 are configured to be disposed in the non-grooved portion 1*b* on the same end-portion side in the standby state that is maintained in the stationary state. Here, as an example, in a configuration where, when the cap-lifting mechanism 2 and the wiper member 3 move to one non-grooved-portion 1*b* side, the state where the cap-lifting mechanism 2 is disposed in the non-grooved portion 1*b* and the wiper member 3 is threaded to the groove 1*c* of the grooved portion 1*a* becomes the standby state, in a state where the one of the cap-lifting mechanism 2 and the wiper member 3 is disposed in the non-grooved portion 1*b*, before the other reaches the non-grooved portion 1*b*, it becomes necessary to control a rotation count of the lead screw 1 to stop the other at a predetermined position in the grooved portion 1*a*. Therefore, by the above configuration, by merely disposing both the cap-lifting mechanism 2 and the wiper member 3 in the non-grooved portion 1*b* of the lead screw 1, the cap-lifting mechanism 2 and the wiper member 3 can easily be put into the stationary state (standby state) without performing a control such as above.

Furthermore, in the first example, as above, in the situation where both the cap-lifting mechanism 2 and the wiper member 3 are disposed in the non-grooved portion 1*b*, provided is the compression spring 11 that imparts to the cap-lifting mechanism 2 and the wiper member 3 the biasing force toward the grooved portion 1*a*, and the compression spring 11 is configured to not impart the biasing force to the other of the cap-lifting mechanism 2 and the wiper member 3 when, after the one of the cap-lifting mechanism 2 and the wiper member 3 is threaded to the groove 1*c* of the grooved portion 1*a* by the biasing force, the other is disposed in the non-grooved portion 1*b*. As a result, when, in the standby state, both the cap-lifting mechanism 2 and the wiper member 3 are disposed in the non-grooved portion 1*b* on the same end-portion side, by the compression spring 11, only one of the cap-lifting mechanism 2 and the wiper member 3 can be easily threaded to the groove 1*c* of the grooved portion 1*a*.

Furthermore, in the first example, as above, the cap-lifting mechanism 2 and the wiper member 3 respectively comprise the first linking portion 20*d* and the second linking portion 32 that link to each other, wherein the second linking portion 32 is formed so as to extend in the axial direction and is configured to link at the linking position separated a predetermined interval from the installation position on the lead screw 1. As a result, the first linking portion 20*d* and the second linking portion 32 can be linked at the linking position separated by the predetermined interval from the installation position on the lead screw 1; this enables a simple configuration where the one of the cap-lifting mechanism 2 and the wiper member 3 links to the other after moving the predetermined distance.

Furthermore, in the first example, as above, the second linking portion 32 may comprise the forked resin spring 32*a* that, when threading the one of the cap-lifting mechanism 2 and the wiper member 3 to the groove 1*c* of the grooved portion 1*a* in the state where the first linking portion 20*d* and the second linking portion 32 are linked to each other, absorbs, by elastically deforming, movement of the other of the cap-lifting mechanism 2 and the wiper member 3 in the axial direction corresponding to the one rotation of the spiral groove 1*c*. As a result, even when the grooved portion 1*a* of the lead screw 1 is in a rotation position where it cannot be immediately threaded to the one of the cap-lifting mechanism 2 and the wiper member 3, by the forked resin spring 32*a*, the movement of the other of the cap-lifting mechanism 2 and the wiper member 3 in the axial direction corresponding to the one rotation of the spiral groove 1*c* can be absorbed. As a result, the one of the cap-lifting mechanism 2 and the wiper member 3 can be reliably threaded to the groove 1*c* of the grooved portion 1*a* of the lead screw 1 while suppressing a large load from being applied to the first linking portion 20*d* and the second linking portion 32. Moreover, by the forked resin spring 32*a*, when the first linking portion 20*d* and the second linking portion 32 link, a large load being applied to the first linking portion 20*d* and the second linking portion 32 can be easily suppressed.

Furthermore, in the first example, as above, the wiper member 3 may comprise the plurality of wiping units 31 that wipes the ink by sliding over the ejecting surfaces 104*e*, the cap member may comprise the plurality of sealing portions 21*a* that covers the ejecting surfaces 104*e* by abutting the ejecting surfaces 104*e*, one lead screw 1 is provided, and a configuration is such that an identical number of wiping units 31 and sealing portions 21*a* is disposed respectively on both sides of the lead screw 1 in the horizontal direction orthogonal to the axial direction. As a result, an even load is applied on the lead screw 1, and the sealing portions 21*a* and the wiping units 31 can be suppressed from inclining in the horizontal direction; therefore, the ink of the ejecting surfaces 104*e* can be wiped with an even pressure by the plurality of wiping units 31. Moreover, the ejecting surfaces 104*e* can be sealed with an even pressure by the plurality of sealing portions 21*a*.

Second Example

Next, one or more embodiments of the second example are described with reference to FIGS. 1, 2, and 15. In this second example, unlike the first example above configured so the cap-lifting mechanism 2 or the wiper member 3 is threaded to the groove 1*c* of the grooved portion 1*a* by elastically deforming the forked resin spring 32*a* provided in a second linking portion 232, an example is described of a configuration of threading the cap-lifting mechanism 2 or the wiper member 3 to the groove 1*c* of the grooved portion 1*a* by elastically deforming a cushion member 232*a* provided to the second linking portion 232. Configurations similar to those of the first example are illustrated labeled with the same reference signs as those in the first example, and description thereof is omitted.

Figure 15:
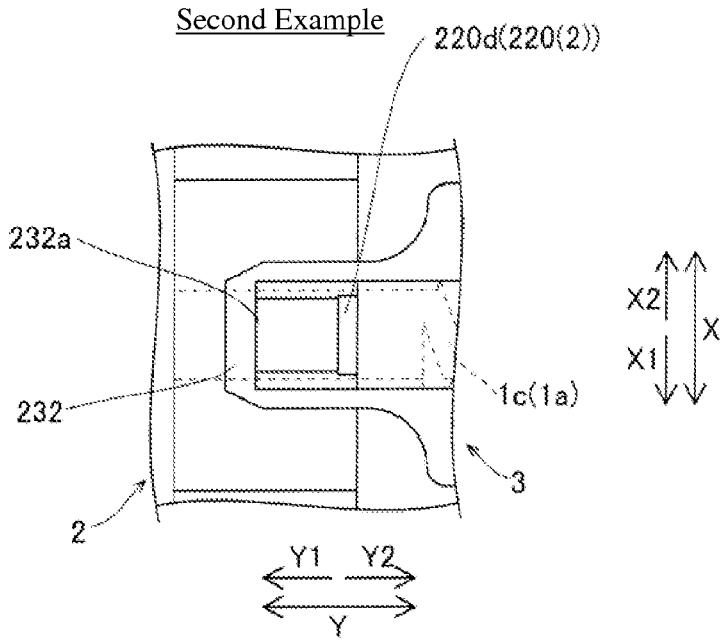
FIG. 15 is a partial enlarged view illustrating a cushion member of the image forming apparatus according to one or more embodiments of the invention.

As illustrated in FIG. 15, in an image forming apparatus 200 (see FIGS. 1 and 2) according to one or more embodiments the second example, the second linking portion 232 has the cushion member 232*a*. Moreover, the second linking portion 232 is not formed in a forked shape as in the first example. The second linking portion 232 has a tip (rear end) closed, and a plate-like first linking portion 220*d* protruding to an inner side of the second linking portion 232 is disposed opposing an end of the second linking portion 232. Moreover, the cushion member 232*a* is disposed in a position interposed between the tip of the second linking portion 232 and the plate-like first linking portion 220*d*.

According to one or more embodiments of the second example, effects such as below can be obtained.

In the second example, similarly to the first example above, one of the cap-lifting mechanism 2 and the wiper member 3 is configured to independently start movement while being threaded to the groove 1*c* of the grooved portion 1*a*, link with the other of the cap-lifting mechanism 2 and the wiper member 3 in the stationary state by moving the predetermined distance to thread the other to the groove 1*c* of the grooved portion 1*a*, and move to the non-grooved portion 1*b* and stop. As a result, the device can be suppressed from becoming large in size.

Furthermore, in the second example, as above, the cushion member 232*a* is provided to the second linking portion 232. As a result, when the first linking portion 220*d* and the second linking portion 232 link, a large load being applied to the first linking portion 220*d* and the second linking portion 232 can be easily suppressed.

Third Example

Next, one or more embodiments of the third example are described with reference to FIGS. 1, 2, and 16. In this third example, unlike the first example above configured so the cap-lifting mechanism 2 or the wiper member 3 is threaded to the groove 1*c* of the grooved portion 1*a* by elastically deforming the forked resin spring 32*a* provided in the second linking portion 32, an example is described of a configuration of threading the cap-lifting mechanism 2 or the wiper member 3 to the groove 1*c* of the grooved portion 1*a* by elastically deforming a compression spring 332*a* provided to a second linking portion 332. Configurations similar to those of the first example are illustrated labeled with the same reference signs as those in the first example, and description thereof is omitted.

Figure 16:
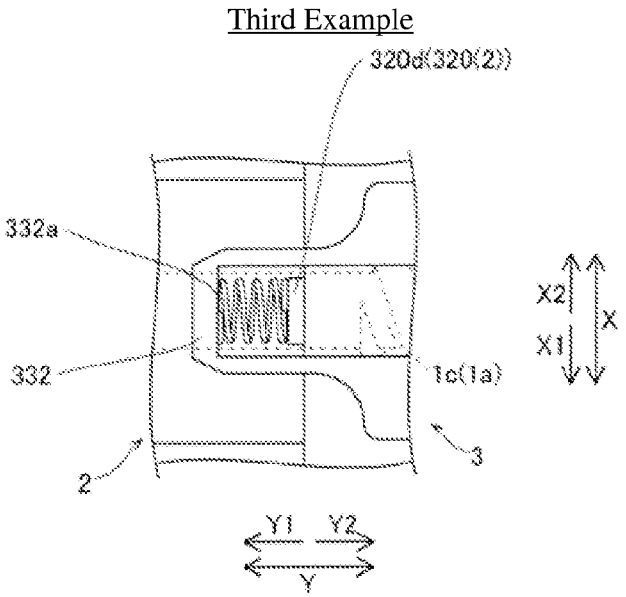
FIG. 16 is a partial enlarged view illustrating a compression spring of the image forming apparatus according to one or more embodiments of the invention.

As illustrated in FIG. 16, in an image forming apparatus 300 (see FIGS. 1 and 2) according to one or more embodiments of the third example, the second linking portion 332 has the compression spring 332*a*. Moreover, the second linking portion 332 is not formed in a forked shape as in the first example. The second linking portion 332 has a tip (rear end) closed, and a plate-like first linking portion 320*d* protruding to an inner side of the second linking portion 332 is disposed opposing the tip of the second linking portion 332. Moreover, the compression spring 332*a* is disposed in a position interposed between the tip of the second linking portion 332 and the plate-like first linking portion 320*d*.

According to one or more embodiments of the third example, effects such as below can be obtained.

In the third example, similarly to the first example above, one of the cap-lifting mechanism 2 and the wiper member 3 is configured to independently start movement while being threaded to the groove 1*c* of the grooved portion 1*a*, link with the other of the cap-lifting mechanism 2 and the wiper member 3 in the stationary state by moving the predetermined distance to thread the other to the groove 1*c* of the grooved portion 1*a*, and move to the non-grooved portion 1*b* and stop. As a result, the device can be suppressed from becoming large in size.

Furthermore, in the third example, as above, the compression spring 332*a* is provided to the second linking portion 332. As a result, when the first linking portion 320*d* and the second linking portion 332 link, a large load being applied to the first linking portion 320*d* and the second linking portion 332 can be easily suppressed.

The embodiments herein disclosed are examples on all counts and should not be considered limiting. The scope of the invention is indicated not by the above description of the embodiments but by the scope of the patent claims and further includes meanings equivalent to the scope of patent claims and all modifications (modified examples) within the scope.

For example, in the embodiments of the first to third examples above, an example is illustrated where both the cap-lifting mechanism and the wiper member are disposed in the non-grooved portion in the standby state, but the present invention is not limited thereto. In the present invention, a configuration may be such that one of the cap-lifting mechanism and the wiper member is disposed in the non-grooved portion and the other of the cap-lifting mechanism and the wiper member is continuously disposed in the grooved portion.

Furthermore, in the embodiments of the first to third examples above, an example is illustrated where the second linking portion is configured to extend in the axial direction, but the invention is not limited thereto. In the invention, the first linking portion may be configured to extend in the axial direction. Moreover, both the first linking portion and the second linking portion may be configured to extend in the axial direction.

Furthermore, in the embodiments of the first to third examples above, an example is illustrated where the elastically-deforming portion of the invention is provided to the second linking portion, but the invention is not limited thereto. In one or more embodiments of the invention, the elastically-deforming portion may be provided to the first linking portion. Moreover, the elastically-deforming portion of the invention may be provided to both the first linking portion and the second linking portion.

Furthermore, in the embodiments of the first to third examples above, an example is illustrated where the elastically-deforming portion of the invention is configured to be able to absorb the movement of the cap-lifting mechanism or the wiper member in the axial direction corresponding to the one rotation of the spiral groove 1*c*, but the invention is not limited thereto. In one or more embodiments of the invention, for example, the elastically-deforming portion may be configured to be able to absorb a movement of the cap-lifting mechanism or the wiper member in the axial direction corresponding to two rotations of the spiral groove 1*c*.

Furthermore, in the embodiments of the first to third examples above, an example is illustrated where, as the biasing member of the invention, the compression spring is provided to the lead screw, but the invention is not limited thereto. In one or more embodiments of the invention, for example, as the biasing member, a rubber member may be provided to the lead screw.

Furthermore, in the embodiments of the first to third examples above, an example is illustrated where two members (the lifting member of the cap-lifting mechanism and the wiper member) that are threaded to the lead screw are provided, but the invention is not limited thereto. In one or more embodiments of the invention, three or more members that are threaded to the lead screw may be provided. For example, the lifting member of the cap-lifting mechanism, a wiper member for black, and a wiper member for color threaded to the lead screw may be provided.

Furthermore, in the embodiments of the first to third examples above, an example is illustrated where the plurality of sealing portions is included, but the invention is not limited thereto. In one or more embodiments of the invention, one sealing portion may be provided.

Furthermore, in the embodiments of the first to third examples above, an example is illustrated where the plurality of wiping units is included, but the invention is not limited thereto. In one or more embodiments of the invention, one wiping unit may be provided.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

1 Lead screw
1*a* Grooved portion (first region)
1*b* Non-grooved portion (second region)
1*c* Groove
2 Cap-lifting mechanism (cap mechanism or moving object)
3 Wiper member (moving object)
11 Compression spring (biasing member)
20*d*, 220*d*, 320*d* First linking portion
21 Cap member
21*a* Sealing portion
31 Wiping unit (wiper)
32, 232, 332 Second linking portion
32*a* Forked resin spring
100, 200, 300 Image forming apparatus
104 Printing head
104*e* Ejecting surface
232*a* Cushion member
332*a* Compression spring
P Sheet

What is claimed is:

1. An image forming apparatus, comprising:

a lead screw that comprises:

a first region formed with a spiral groove and provided in a central portion of the lead screw; and two second regions formed without a groove, one provided on an end-portion side of the first region and the other provided on another end-portion side of the first region;

a cap mechanism that comprises:

a first threaded portion threaded to the groove and that lifts a cap member that covers an ejecting surface of ink; and a first linking portion;

a wiper member that comprises:

a second threaded portion threaded to the groove and that wipes ink adhered to the ejecting surface of the ink; and a second linking portion that links with the first linking portion, wherein the cap mechanism lifts or lowers the cap member and the wiper member wipes the ink when the lead screw is rotated, one of the cap mechanism and the wiper member starts moving from one of the second regions while the first threaded portion or the second threaded portion is threaded to the groove, upon moving a predetermined distance, the one of the cap mechanism and the wiper member links to the other that is in a stationary state via the first linking portion and the second linking portion, after the cap mechanism and the wiper member have linked, the first threaded portion or the second threaded portion is threaded to the groove of the first region, and upon reaching the other of the second regions, the one of the cap mechanism and the wiper member stops moving.

2. The image forming apparatus according to claim 1, wherein both the cap mechanism and the wiper member are in the one of the second regions in a standby state in which both the cap mechanism and the wiper member are stationary.

3. The image forming apparatus according to claim 2, further comprising a biasing member that imparts to the cap mechanism and the wiper member a biasing force toward the first region when both of the cap mechanism and the wiper member are in the one of the second regions.

4. The image forming apparatus according to claim 3, wherein the biasing member does not impart the biasing force to the other of the cap mechanism and the wiper member after the one of the cap mechanism and the wiper member is threaded to the first region by the biasing force and when the other of the cap mechanism and the wiper member is in the one of the second regions.

5. The image forming apparatus according to claim 3, wherein at least one of the first linking portion and the second linking portion extends in an axial direction of the lead screw, and the first linking portion and the second linking portion get linked at a linking position separated a predetermined interval from an installation position on the lead screw.

6. The image forming apparatus according to claim 3, wherein the cap mechanism further comprises the cap member.

7. The image forming apparatus according to claim 3, wherein the wiper member further comprises a plurality of wipers, the cap member comprises a plurality of sealing portions, and an identical number of wipers and sealing portions is disposed respectively on both sides of the lead screw in a direction orthogonal to the axial direction.

8. The image forming apparatus according to claim 2, wherein at least one of the first linking portion and the second linking portion extends in an axial direction of the lead screw, and the first linking portion and the second linking portion get linked at a linking position separated a predetermined interval from an installation position on the lead screw.

9. The image forming apparatus according to claim 2, wherein the cap mechanism further comprises the cap member.

10. The image forming apparatus according to claim 2, wherein the wiper member further comprises a plurality of wipers, the cap member comprises a plurality of sealing portions, and an identical number of wipers and sealing portions is disposed respectively on both sides of the lead screw in a direction orthogonal to the axial direction.

11. The image forming apparatus according to claim 1, wherein at least one of the first linking portion and the second linking portion extends in an axial direction of the lead screw, and the first linking portion and the second linking portion get linked at a linking position separated a predetermined interval from an installation position on the lead screw.

12. The image forming apparatus according to claim 11, wherein at least one of the first linking portion and the second linking portion comprises an elastically-deforming portion that absorbs by elastically deforming, when threading the one of the cap mechanism and the wiper member to the first region in a state where the first linking portion and the second linking portion are linked to each other, movement of the other of the cap mechanism and the wiper member in the axial direction corresponding to at least one rotation of the groove.

13. The image forming apparatus according to claim 12, wherein the elastically-deforming portion is made from a resin spring, a cushion member, or a compression spring.

14. The image forming apparatus according to claim 1, wherein the cap mechanism further comprises the cap member.

15. The image forming apparatus according to claim 1, wherein the wiper member further comprises a plurality of wipers, the cap member comprises a plurality of sealing portions, and an identical number of wipers and sealing portions is disposed respectively on both sides of the lead screw in a direction orthogonal to the axial direction.

* * * * *